US005934796A

United States Patent [19]

Quereau

[11] Patent Number: 5,934,796

[45] Date of Patent: Aug. 10, 1999

[54] ORNAMENTAL LIGHTING APPARATUS FOR POOL USING REFLECTORS ON A CURVED SURFACE

[76] Inventor: Benjamin H. Quereau, 59 Annwood La., Wayne, Pa. 19087

[21] Appl. No.: 08/995,931

[22] Filed: Dec. 22, 1997

[51] Int. Cl.[6] ..... F21V 7/04; F21L 15/08

[52] U.S. Cl. ..... 362/318; 362/35; 362/101; 362/158; 362/247; 362/806

[58] Field of Search ..... 362/96, 35, 101, 362/158, 184, 185, 234, 241, 247, 297, 346, 348, 477, 806

[56] References Cited

U.S. PATENT DOCUMENTS

| | | | |
|---|---|---|---|
| 687,738 | 12/1901 | Fleming | 362/318 |
| 1,718,560 | 6/1929 | Hollnagel | 362/101 |
| 1,902,132 | 3/1933 | Klapper | 362/101 |
| 2,481,054 | 9/1949 | Wendel | 362/96 |
| 3,264,463 | 8/1966 | Bonner, Jr. | 362/158 |
| 3,302,014 | 1/1967 | Moore et al. | 362/267 |
| 3,569,692 | 3/1971 | Johnson et al. | 362/267 |
| 3,748,457 | 7/1973 | Balitzky et al. | 362/158 |
| 3,793,516 | 2/1974 | Cassey | 362/257 |
| 3,801,022 | 4/1974 | Cassey | 362/257 |
| 3,829,675 | 8/1974 | Mariani | 362/296 |
| 3,955,076 | 5/1976 | Shaw | 362/183 |
| 4,088,880 | 5/1978 | Walsh | 362/96 |
| 4,305,117 | 12/1981 | Evans | 362/96 |
| 4,394,716 | 7/1983 | Campagna et al. | 362/158 |
| 4,429,350 | 1/1984 | Guthrie | 362/120 |
| 4,661,893 | 4/1987 | Robinson et al. | 362/267 |
| 4,779,174 | 10/1988 | Staten et al. | 362/158 |
| 4,782,430 | 11/1988 | Robbins et al. | 362/562 |
| 4,920,465 | 4/1990 | Sargent | 362/96 |
| 5,122,936 | 6/1992 | Guthrie | 362/101 |
| 5,144,545 | 9/1992 | Klitzing | 362/101 |
| 5,299,103 | 3/1994 | Kielland | 362/101 |
| 5,349,505 | 9/1994 | Poppenheimer | 362/101 |
| 5,595,440 | 1/1997 | Gordin et al. | 362/247 |

*Primary Examiner*—Alan Cariaso
*Attorney, Agent, or Firm*—Michael F. Petock, Esq.

[57] ABSTRACT

An ornamental lighting apparatus for a pool uses reflectors on a curved surface wherein the curved surface is preferably a hemisphere with a plurality of mirrors mounted on its outer surface. The hemisphere is connected to one or more lights which are directed at the mirrors on the hemisphere. Although movement of the lighting apparatus and/or the water in the pool is sufficient to create a varying light pattern on the sides and bottom of the pool, in a preferred embodiment, the mirrored hemisphere is rotated with respect to the lights to create a moving pattern of light on the pool walls and bottom. The lighting apparatus may be positioned such that a base unit is resting on the bottom of the pool with the connector between the light containing base unit and the hemisphere being of adjustable length. Alternatively, the entire lighting apparatus may float within the pool and the connector may be of fixed length. The hemisphere may be formed to be a closed container with a resealable opening and the buoyancy of the apparatus may be adjusted by adding selected amounts of water to the hemisphere. The lighting and the motor for rotation, if used, may be powered by a low-voltage rechargeable battery.

22 Claims, 3 Drawing Sheets

ORNAMENTAL LIGHTING APPARATUS FOR POOL USING REFLECTORS ON A CURVED SURFACE

FIELD OF THE INVENTION

The present invention relates to an ornamental lighting apparatus for a pool using reflectors on a curved surface. More particularly, the present invention preferably utilizes a hemispheric shape having a plurality of mirrors mounted thereon which are illuminated from a connected light source to create a moving pattern of light on the walls and bottom of the pool.

BACKGROUND OF THE INVENTION

Pools of water for recreation and decoration have become wide-spread in both the residential and business environment. It has become a common place for residences to have swimming pools, either in ground or above ground. Many organizations and/or businesses, such as hotels and recreational facilities have swimming pools. Further, many businesses and other organizations utilize pools of water for decoration of their facilities. Although, in many cases, swimming pools are utilized for recreation by swimming or bathing in the pools, they are also a source of ornamentation and beautification of the property. These are often the setting for parties and other gatherings.

The present invention enhances the beautification, ornamentation and decorative effects of various types of pools of water.

SUMMARY OF THE INVENTION

The present invention relates to an ornamental lighting apparatus for a pool using reflectors on a curved surface. The present invention may be utilized in residential swimming pools and swimming pools of businesses and other organizations, as well as other pools utilized solely for decorative purposes on properties and the like.

The present invention provides an economical apparatus for significantly enhancing the decorative and ornamental effect of a pool. Further, the apparatus of the present invention may be installed and removed from the pool with ease, not requiring any physical installation or modification of the pool structure. The present invention further provides a rechargeable low voltage non-hazardous lighting structure.

In accordance with the broad concepts of the present invention, an apparatus for creating a lighting display in a pool of water includes a curved surface adapted to be mounted preferably just below the surface of the water of the pool. A plurality of reflectors are mounted on a convex side of the curved surface. The curved surface is connected to a base unit and the base unit is provided with one or more lights, with the light being directed at the plurality of reflectors.

In a presently preferred embodiment, the curved surface would be in the shape of a hemisphere. Preferably, the hemisphere may be rotated with respect to the base lights. The lights and motor may be operated from the energy of a low voltage rechargeable battery.

The base unit may be positioned on the bottom of the pool or it may be suspended from the hemisphere. In a case where the base unit is positioned on the bottom of the pool, a connector connecting the hemisphere and base unit would have an adjustable length so that the hemisphere may be mounted just under the surface of the water. In a case where the base unit is floating, the connector may be of a fixed or adjustable length.

Further, the hemisphere may be a sealed container having a resealable opening so that the buoyancy of the hemisphere may be adjusted by the addition of water to cause floatation at the desired height.

Although a single light may be used, preferably two or three lights would be included in the base unit. The base unit may be of various shapes including those of a tripod or a cylinder. In the floating embodiment, the connector may be any fixed length connector, including a cable.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
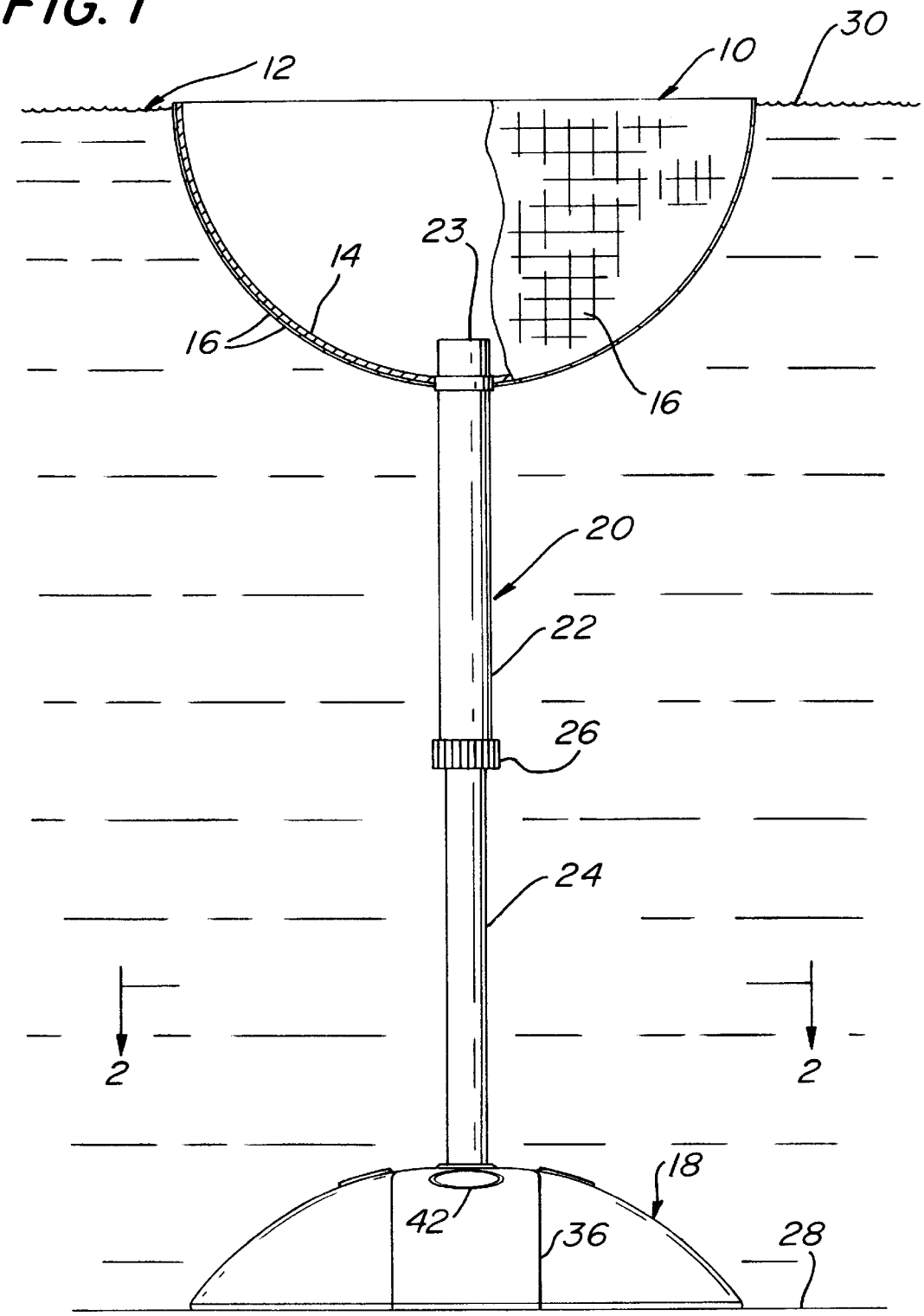
FIG. 1 is an elevation view of an embodiment of the present invention.

Referring now to the drawings in detail, wherein like numerals indicate like elements, there is shown in FIG. 1 an ornamental lighting apparatus 10 in accordance with the present invention. Ornamental lighting apparatus 10 is adapted and designed to be utilized in a pool of water 12. Ornamental lighting apparatus 10 is comprised of a curved surface 14 which is preferably in the shape of a hemisphere. The terms "curved surface" and "hemisphere" will be used interchangeably herein. It is understood that in a preferred embodiment, the curved surface would be in the shape of a hemisphere, but that other suitable curved surfaces may be utilized.

A plurality of reflectors 16 are mounted on the outer surface of hemisphere 14 or on the convex surface of curved surface 14. The reflectors 16 are preferably comprised of mirrors which may be preferably be rectangular in shape and relatively small as compared to the surface area of hemisphere 14. However, it is understood that other shapes of reflectors or mirrors 16 may be utilized in practicing the present invention including, but not limited to, round, oval and rectangular.

Hemisphere 16 is connected to base unit 18 by a connector 20. Connector 20 may be comprised of two sections 22 and 24 which may be slid one into the other and locked in relative position by a clamping means 26, well known in the art. Although it is presently preferred that two connector sections be utilized, it is understood that more than two may be utilized. Furthermore, although it is presently preferred that a clamping means of the type shown at 26 may be utilized, it is understood that numerous other clamping or locking structures may be utilized to lock the two or more sections in relative position, including pins, set screws, spring loaded latches and the like.

Base unit 18 is mounted on bottom 28 of the pool. The length of connector 20 is preferably adjusted by clamping means 26 such that the upper end of hemisphere 14 is approximately at the surface 30 of the pool of water 12.

Figure 2:
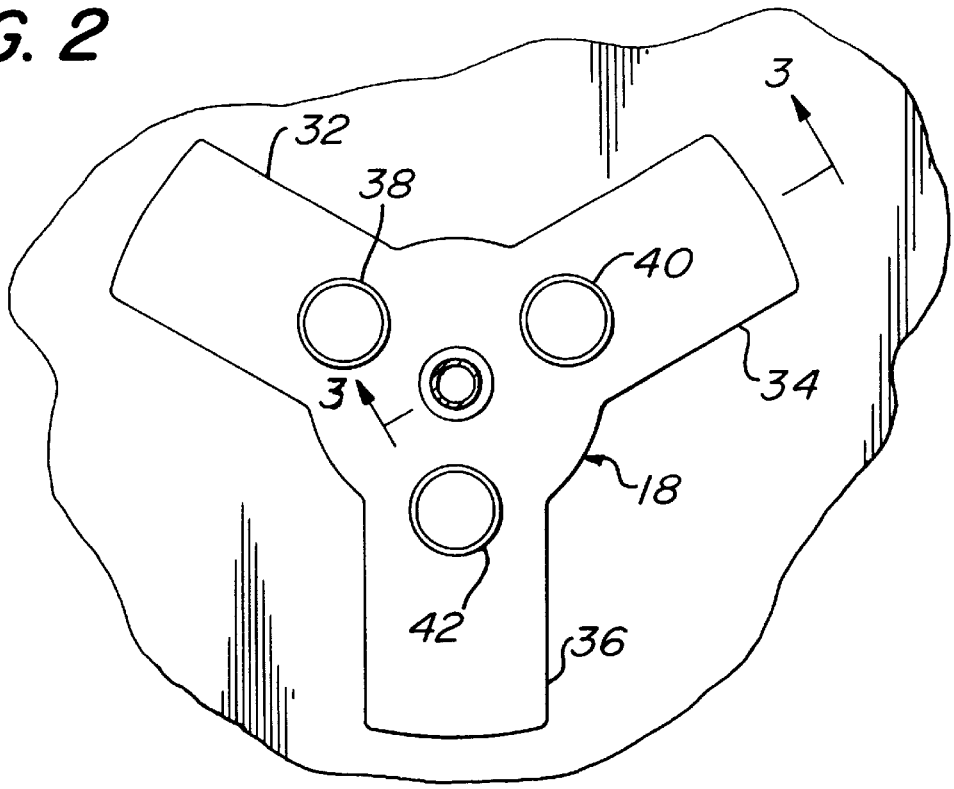
FIG. 2 is a plan view taken along line 2—2 of the base unit of FIG. 1.
Figure 3:
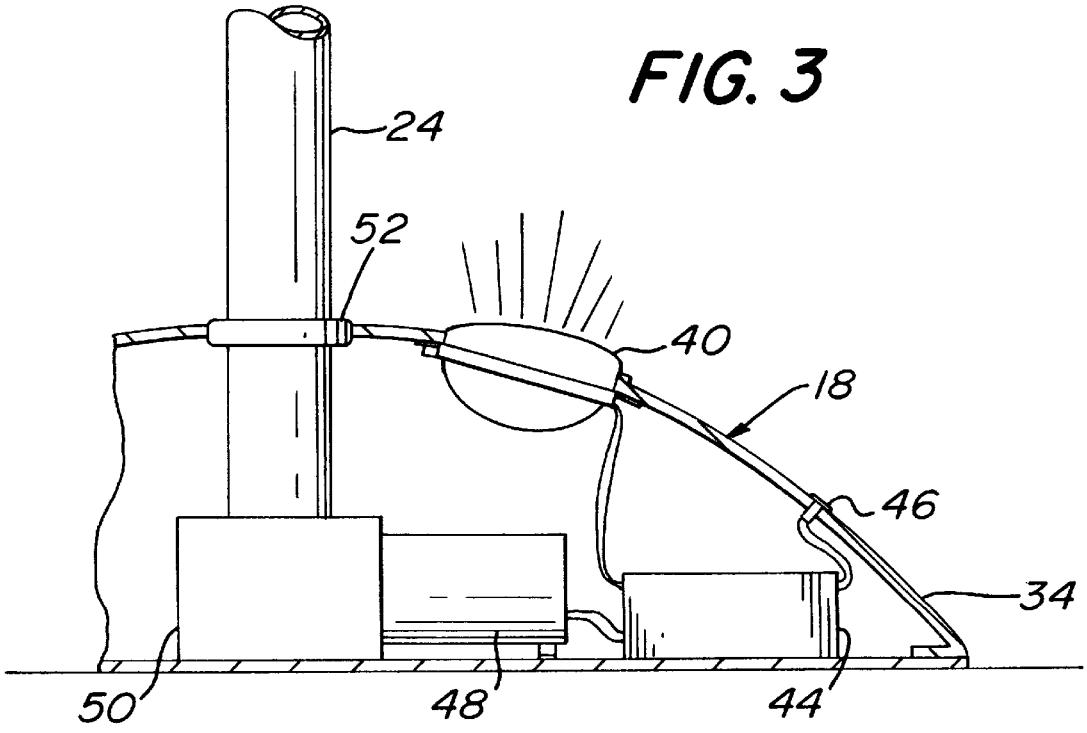
FIG. 3 is a cross-section of view taken along line 3—3 of FIG. 2.

Base unit 18 may be best seen by viewing FIGS. 1, 2 and 3 together. Base unit 18 may preferably be comprised in the shape of a tripod provided with legs or branches 32, 34 and 36. These legs or branches 32, 34 and 36 may be provided with lights 38, 40 and 42 respectively. The lights 38, 40 and 42 are adjustable within base unit 18 so that they may be directed at the reflectors or mirrors 16 on hemisphere 14, particularly when the length of connector 20 is adjusted. This may be best seen in FIG. 3 with respect to light 40 being adjustable within leg 34 of base unit 18. It is understood that a single light may be utilized to achieve the decorative and ornamental effects of the present invention. However, it is presently preferred that two or three lights be utilized and in the presently preferred embodiment illustrated, three lights are utilized.

As may be best seen in FIG. 3, base unit 18 may be provided with a rechargeable low-voltage battery 44. As illustrated in FIG. 3, the rechargeable low-voltage battery is provided with a recharging terminal 46. It is presently preferred that the low-voltage battery 44 have a voltage of less than thirty volts so that it would be safe for use where bathers may be using the pool. In the presently preferred embodiment, low-voltage battery 44 would be a twelve-volt battery. Battery 44 would provide electrical energy to energize lights 38, 40 and 42 and electric motor 48 which would drive lower connector section 24, and thus connector 20, through gear box 50. Such electric motors and gear boxes are well known in the art and will not be described here in detail. A water proof seal 52 which allows rotation of connector section 24 would be provided between connector section 24 and the housing of base unit 18.

In use, the ornamental lighting apparatus would be placed in the pool and adjusted such that the upper end of hemisphere 14 is preferably substantially near the surface of the pool. However, it is understood that the upper end of the hemisphere or curved surface could be higher or lower so long as a substantial portion of the curved surface or hemisphere is below the upper surface 30 of the pool water. When adjusted as shown in FIG. 1, maximum decorative lighting effect would be provided to the sidewalls and the bottom of the pool. As the upper end of hemisphere 14 is raised substantially above or below surface 30, less ornamental moving lighting would be directed to the sidewalls of the pool. Hemisphere 14 is rotated by gear box 50 driven by motor 48 thereby causing a moving pattern of light to be reflected by mirrors 16 onto the sidewalls and bottom of the pool from lights 38, 40 and 42.

Figure 4:
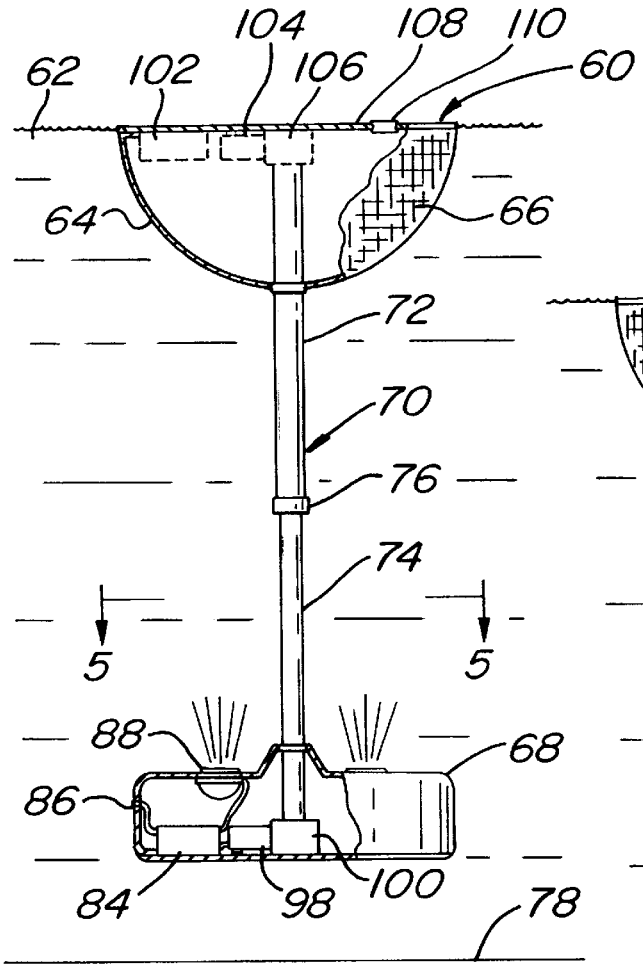
FIG. 4 is an elevation view, partially broken away of another embodiment of the present invention.
Figure 5:
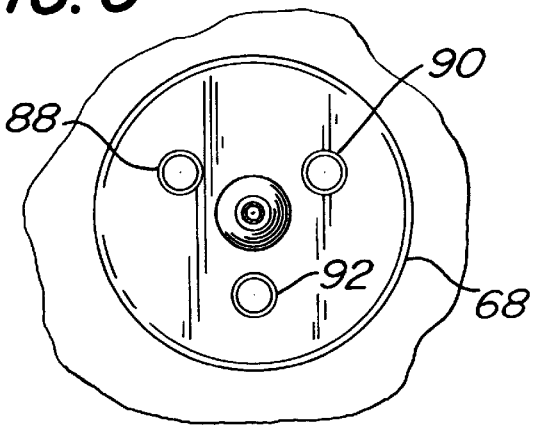
FIG. 5 is a plan view taken along line 5—5 of FIG. 4 of the base unit.

Referring now to FIG. 4, there is shown another embodiment of the present invention wherein an ornamental lighting apparatus. 60 is caused to float in a pool of water 62. Ornamental lighting apparatus 60 includes a curved surface or hemisphere 64 having a plurality of reflectors or mirrors 66 similar to those described with respect to the embodiment of FIG. 1. Hemisphere 64 is connected to base unit 68 via connector 70. Connector 70 may be adjustable by means of clamping means 76 to adjust the relative position of sections 72 and 74 in a manner similar to that as described with respect to FIG. 1. In the embodiment of FIG. 4, base unit 68 is not intended to sit on the bottom 78 of the pool, but is intended to float. The base unit 68 is provided with lights 88, 90 and 92 which are directed at the hemisphere or more specifically to the reflectors or mirrors 66 mounted on hemisphere 64. Base unit 68 may be substantially cylindrically shaped as shown in FIGS. 4 and 5, or it may be any other suitable shape including the tripod structure of FIG. 1 or any other suitable shape including that of a disc which may be elliptical in vertical cross-section. In other words, it is noted that there is no need for a flat bottom in this embodiment as it does not sit on the bottom of the pool.

Base unit 68 may be provided with a low-voltage rechargeable battery 84 supplied with a recharging terminal 86 as described with respect to FIG. 1. Similarly, as described with respect to FIG. 1, base unit 68 may include an electric motor 98 and a gear box 100 for causing connector 70 and the attached hemisphere 64 to rotate with respect to the base unit. It is understood that the battery, electric motor and gear box may be mounted in hemisphere 64 as shown in dotted lines at 102, 104 and 106, respectively in FIG. 4. In such a case, electric power would be supplied to the lights in the base unit 68 by means of an electrical connection, such as a wire travelling through connector 70. As illustrated in FIGS. 1 through 5, connectors 20 and 70 may be any suitable tubing or piping, preferably constructed of plastic. However, such connector may be made of a solid rod or bar.

Hemisphere 64 of FIG. 4 is provided with a closed flat top 108 to form hemisphere 64 in the form a sealed container. Hemisphere 64 is provided with a resealable opening 110 which may be utilized for the addition of water into container 64 to adjust the buoyancy of hemisphere 64. Such adjustment of the buoyancy will adjust the degree of floatation of ornamental lighting apparatus 60 in the pool of water. With hemisphere 64 containing only air, there will maximum buoyancy.

It is understood that the embodiment of FIG. 1 could also be provided with a closure for its top and a resealable opening. As illustrated in FIG. 1, the inside of hemisphere 14 could be filled or partially filled with water to ensure that the ornamental lighting apparatus remains firmly positioned on the bottom of the pool. As illustrated in FIG. 1, the upper section 22 of connector 20 would be provided with a seal top at 23. It is also understood that the base unit 68 of FIG. 4 could be utilized in connection with the embodiment of FIG. 1 and that the base unit 18 of FIG. 1 could be utilized with the embodiment of FIG. 4. If the base unit 18 were utilized with the embodiment of FIG. 4, the legs 32, 34 and 36 would provide stability or resistance to rotation of the base unit. However, in the embodiment of FIG. 4, it is only necessary that the base unit with the lights rotate with respect to the reflectors on the hemisphere, and the desired ornamental lighting effect is created by this relative rotation one with respect to the other.

Figure 6:
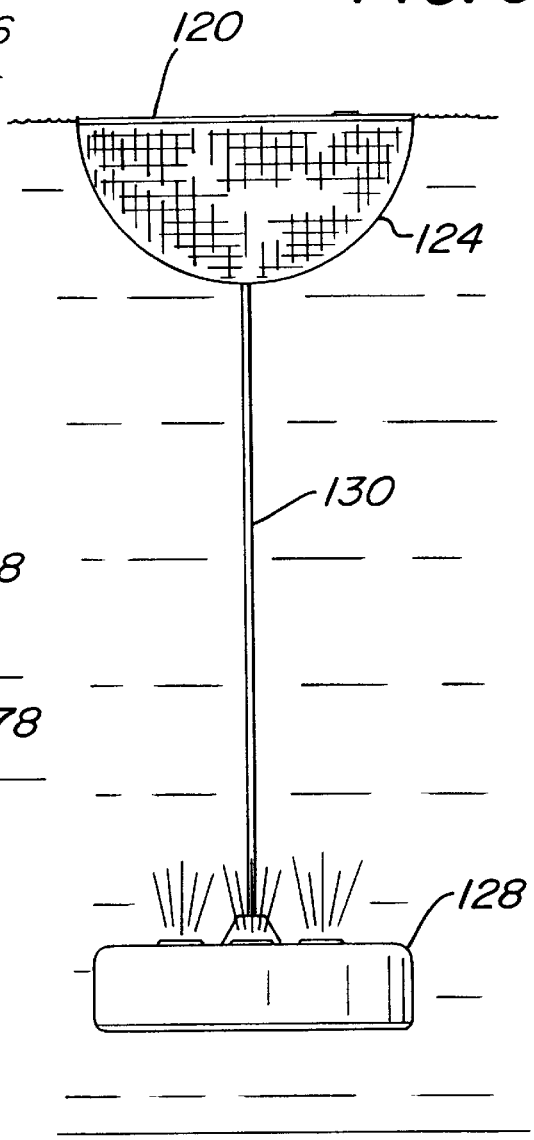
FIG. 6 is an elevation view of another embodiment of the present invention.

Referring now to FIG. 6, there is shown another embodiment of the present invention illustrating an ornamental lighting apparatus 120 which is similar to that described with respect to FIG. 4 except that it is provided with a connector 130 which may not be adjustable in length and which may be a narrow tube or cable. In the embodiment of FIG. 6, the hemisphere 124 would not rotate with respect to the base unit 128, but the moving light display on the sides and bottom of the pool would be provided by movement of ornamental lighting apparatus 120 as it floats freely in the water and by ripples on the surface of the water.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. Apparatus for creating a lighting display in a pool of water, comprising:

a curved surface adapted to be mounted below the surface of said pool of water;

a plurality of reflectors mounted on a convex side of said curved surface;

said curved surface being connected to a base unit by a connector; and said base unit being provided with at least one light, said light being adapted to direct light at said plurality of reflectors.

2. An apparatus in accordance with claim 1 including means for moving said curved surface with the reflectors thereon with respect to said light of said base unit.

3. An apparatus in accordance with claim 1 wherein said connector is a rigid member.

4. An apparatus in accordance with claim 3 wherein said curved surface rotates with respect to said base unit.

5. An apparatus in accordance with claim 1 wherein said reflectors are mirrors.

6. An apparatus in accordance with claim 1 wherein said curved surface is the shape of a hemisphere.

7. An apparatus in accordance with claim 6 wherein said hemisphere is provided with adjustable buoyancy.

8. An apparatus in accordance with claim 7 wherein said hemisphere is a closed container having a resealable opening therein, said adjustable buoyancy being achieved by adjusting the amount of water in said hemisphere.

9. An apparatus in accordance with claim 4, including a motor, said motor being caused to provide said rotation.

10. An apparatus in accordance with claim 9 wherein said motor and said light are operated from a rechargeable battery providing a voltage of less than 30 volts.

11. An apparatus in accordance with claim 1 wherein said base unit is provided with three lights.

12. An apparatus for creating a lighting display in a pool of water, comprising:

a substantially hemispheric shaped member;

a plurality of reflectors mounted on an outer surface of said hemispheric shaped member;

a base unit adapted to be mounted on a bottom surface of said pool;

a substantially rigid, adjustable length connector connecting said hemispheric shaped member to said base unit, said length of said connector being adjustable such that an upper end of said hemisphere is substantially near the surface of the pool of water;

said base units including a plurality of lights adapted to be directed at said plurality of reflectors mounted on said hemispheric shaped member; and motor means for causing said connector to rotate causing rotation between said hemispheric shaped member and said base unit.

13. An apparatus in accordance with claim 12 wherein said base unit is in the shape of a tripod.

14. An apparatus in accordance with claim 12 wherein said base unit includes three lights.

15. An apparatus in accordance with claim 12 wherein said motor is located in said base unit, and further wherein said lights and said motor are powered by a rechargeable battery.

16. An apparatus in accordance with claim 12 wherein said substantially hemispheric shaped member is provided with a substantially flat upper surface to form a closed container in the form of a hemisphere.

17. An apparatus in accordance with claim 16 wherein said substantially flat upper surface is provided with a resealable opening such that buoyancy may be adjusted by adding water.

18. An apparatus for creating a lighting display in pool of water comprising:

a substantially hemispheric shaped closed container having a resealable opening;

a plurality of reflectors mounted on an outer surface of said hemispheric shape of said closed container;

a base unit, said base unit including a plurality of lights;

a connector connecting said substantially hemispheric shaped closed container and said base unit; and whereby buoyancy of said substantially hemispheric shaped closed container may be adjusted by adding water to said hemispheric shaped container through said resealable opening such that said hemispheric shaped container and said base unit will float and the length of said connector is selected such that the base unit does not contact a bottom of said pool.

19. An apparatus in accordance with claim 18 including a motor for causing rotation between said hemisphere and said base unit.

20. An apparatus in accordance with claim 19 wherein said base unit is substantially cylindrically shaped.

21. An apparatus in accordance with claim 18 wherein said connector is a cable.

22. An apparatus in accordance with claim 18 wherein said lights are powered by a rechargeable low voltage battery.

* * * * *

UNITED STATES PATENT AND TRADEMARK OFFICE

CERTIFICATE OF CORRECTION

PATENT NO. : 5,934,796
DATED : August 10, 1999
INVENTOR(S) : Benjamin H. Quereau It is certified that error appears in the above-indentified patent and that said Letters Patent is hereby corrected as shown below:

Column 3, line 52: delete "." after "apparatus"

Signed and Sealed this

Fourteenth Day of December, 1999

*Attest:*

*Attesting Officer*

Q. TODD DICKINSON

*Acting Commissioner of Patents and Trademarks*